US007500925B2

(12) United States Patent
Mori et al.

(10) Patent No.: US 7,500,925 B2
(45) Date of Patent: Mar. 10, 2009

(54) GOLF CLUB AND METHOD OF DESIGNING HOLLOW GOLF CLUB HEAD

(75) Inventors: Tomoaki Mori, Kanagawa (JP); Masahiko Miyamoto, Kanagawa (JP); Yoh Nishizawa, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 74 days.

(21) Appl. No.: 10/537,776

(22) PCT Filed: Dec. 8, 2003

(86) PCT No.: PCT/JP03/15670

§ 371 (c)(1), (2), (4) Date: Jun. 6, 2005

(87) PCT Pub. No.: WO2004/052473

PCT Pub. Date: Jun. 24, 2004

(65) Prior Publication Data

US 2006/0084521 A1 Apr. 20, 2006

(30) Foreign Application Priority Data

Dec. 6, 2002 (JP) ..... 2002-355821

(51) Int. Cl.
*A63B 53/04* (2006.01)

(52) U.S. Cl. ..... 473/345; 473/348

(58) Field of Classification Search ..... 473/324–350
See application file for complete search history.

(56) References Cited

U.S. PATENT DOCUMENTS

| | | | | |
|---|---|---|---|---|
| 4,971,321 | A * | 11/1990 | Davis | 473/287 |
| 5,425,538 | A * | 6/1995 | Vincent et al. | 473/342 |
| 5,494,281 | A * | 2/1996 | Chen | 473/329 |
| 6,645,086 | B1 * | 11/2003 | Chen | 473/335 |
| 6,849,003 | B2 * | 2/2005 | Kumamoto | 473/305 |
| 6,881,292 | B2 * | 4/2005 | Chen | 156/293 |
| 6,969,326 | B2 * | 11/2005 | De Shiell et al. | 473/345 |
| 7,037,214 | B2 * | 5/2006 | Nakahara et al. | 473/345 |
| 2003/0013548 | A1 * | 1/2003 | Kouno | 473/345 |
| 2003/0186760 | A1 * | 10/2003 | Lee | 473/342 |

FOREIGN PATENT DOCUMENTS

| | | |
|---|---|---|
| JP | 61-149179 | 7/1986 |
| JP | 63-257583 | 10/1988 |
| JP | 2-232074 | 9/1990 |
| JP | 4-89071 | 3/1992 |
| JP | 7-112041 | 5/1995 |
| JP | 09-70455 | 3/1997 |
| JP | 10-155943 | 6/1998 |
| JP | 11-76469 | 3/1999 |
| JP | 2001-269425 | 10/2001 |
| JP | 2002-537915 | 11/2002 |
| WO | WO 00/51693 | 9/2000 |

* cited by examiner

*Primary Examiner*—Gene Kim
*Assistant Examiner*—Alvin A Hunter
(74) *Attorney, Agent, or Firm*—Finnegan, Henderson, Farabow, Garrett & Dunner, L.L.P.

(57) ABSTRACT

The golf club head (14) of the present invention has a face portion (24) for striking a golf ball, a crown portion (18) connected to the face portion (24), and a sole portion (22) connected to the face portion (24). The ratio of either lower of a first equivalent rigidity of a crown member (18) and a second equivalent rigidity of a sole member (22) to the higher is equal to or less than 0.75. The present invention provides a golf club (10) provided with the hollow golf club head (14) capable of increasing the carry of a golf ball based on a technique for increasing the carry of a golf ball other than conventional ones such as adjustment of the loft angle and reduction in the thickness of the striking surface, and provides a method of designing such a hollow golf club head as well.

10 Claims, 9 Drawing Sheets

HEAD SPEED 40 (m/sec) [INITIAL VELOCITY OF BALL 60 (m/sec)]

GOLF CLUB AND METHOD OF DESIGNING HOLLOW GOLF CLUB HEAD

TECHNICAL FIELD

The present invention relates to a method of designing a hollow golf club head which has a face portion for striking a golf ball, a crown portion connected to the face portion, and a sole portion connected to the face portion. The present invention also relates to a golf club provided with such a golf club head.

PRIOR ART

Through the improvement and development of golf club head structures and materials, golf club makers at present are proposing various types of golf clubs with which even weaker golfers are capable of hitting a golf ball a long distance.

The initial ballistic characteristics of a golf ball have been adjusted in some ways. For example, the launch angle of a struck golf ball has been increased by changing the loft angle of a hollow golf club head or the initial velocity of a golf ball has been increased by reducing the thickness of a golf ball-striking surface to improve the restitution characteristics with respect to a golf ball.

In JP 10-155943 A, a hollow golf club head is disclosed in which a golf ball-striking surface has a thin portion formed along its circumferential edge. Owing to such configuration, elastic deformation of the striking surface is promoted during striking of a golf ball so that the surface has an increased coefficient of restitution with respect to the golf ball. Thus, an increase in the carry of a golf ball is achieved.

Further, with a golf club having a golf club head of which the loft angle is made larger within a predetermined range, the launch angle of a golf ball increases and an increase in the carry is thus achieved.

In addition to an increase in the launch angle, the number of revolutions (backspin rate) of a golf ball increases when the loft angle is made larger in a golf club having a golf club head of which the loft angle is changed. When the loft angle is made smaller, the launch angle becomes smaller and the backspin rate of a golf ball also decreases.

Therefore, there is a problem in that, even if a golf club head having a larger loft angle is used in order to increase the carry, the carry does not increase very much because the backspin rate increases at the same time. In other words, since it is a characteristic of the loft angle that its increase or decrease results in an increase or decrease in the backspin rate and the launch angle alike, the launch angle cannot be increased while the backspin rate is decreased, or again, the launch angle cannot be decreased while the backspin rate is increased. That is, there is a problem in that the backspin rate and the launch angle cannot be changed independently of each other.

Furthermore, even if the characteristics of the loft angle are utilized with the intention of providing the optimal golf club for a golfer, a golf club with an inappropriate loft angle may sometimes be provided because there exists no guideline for the selection of an appropriate golf club on which every golfer having his or her own golf swing should depend. In such cases, the carry of a golf ball may decrease instead of increasing.

In the case where the striking surface of a golf club head is made thinner, on the other hand, the initial velocity of a golf ball can be increased and the carry can be made longer. However, the mechanical strength of the striking surface decreases as a result of the partial reduction in thickness of the surface, thus causing to a problem with durability.

In order to solve the problems described above, the present invention has an object of providing a golf club which has a hollow golf club head capable of increasing the carry of a golf ball based on a technique other than conventional ones such as adjustment of the loft angle and reduction in the thickness of the striking surface. Another object of the present invention is to provide a method of designing such a hollow golf club head.

DISCLOSURE OF THE INVENTION

The above objects are achieved by the present invention providing a golf club comprising a hollow golf club head which has a face portion for striking a golf ball, a crown portion connected to the face portion, and a sole portion connected to the face portion, wherein: a first region whose surface area constitutes 5% or more of a total surface area of the crown portion is formed by a first outer shell member in a region of the crown portion which is located along a connecting edge of the crown portion connecting to the face portion and within a distance of 50 mm from the connecting edge, and a second region whose surface area constitutes 5% or more of the total surface area of the sole portion is formed by a second outer shell member in a region of the sole portion which is located along a connecting edge of the sole portion connecting to the face portion and within a distance of 50 mm from the connecting edge of the sole portion; and when a product of an elastic modulus of the first outer shell member in a direction in which a striking surface is oriented and a thickness of the first outer shell member in the first region is taken as a first equivalent rigidity and a product of an elastic modulus of the second outer shell member in the direction in which the striking surface is oriented and a thickness of the second outer shell member in the second region is taken as a second equivalent rigidity, a ratio of either lower of the first equivalent rigidity and the second equivalent rigidity to the higher is equal to or less than 0.75.

In other words, it is a feature of the present invention that the first and second regions which allow the ratio as above to be equal to or less than 0.75 exist in specified regions of the crown portion and the sole portion of the golf club head, respectively, each of the specified regions being located within 50 mm of the connecting edge of the relevant portion to the face portion, and the first and second regions each have a surface area constituting 5% or more of the total surface area of the relevant portion.

Preferably, either or both of the first and second outer shell members are composed of a composite material in which a fiber reinforced plastic material is laminated. Further, the above ratio is preferably equal to or less than 0.5.

It is preferable that the surface area of the first region constitutes 10% or more of the total surface area of the crown portion and the surface area of the second region constitutes 10% or more of the total surface area of the sole portion. It is also preferable that the first region exists in a region of the crown portion which is located along the connecting edge to the face portion and within 40 mm of the connecting edge and the second region exists in a region of the sole portion which is located along the connecting edge to the face portion and within 40 mm of the connecting edge.

The present invention also provides a method of designing a hollow golf club head which has a face portion for striking a golf ball, a crown portion connected to the face portion, and a sole portion connected to the face portion, wherein: a first region whose surface area constitutes 5% or more of a total surface area of the crown portion is formed by a first outer shell member in a region of the crown portion which is located along a connecting edge of the crown portion connecting to the face portion and within a distance of 50 mm from the connecting edge; a second region whose surface area constitutes 5% or more of a total surface area of the sole portion is formed by a second outer shell member in a region of the sole portion which is located along a connecting edge of the sole portion connecting to the face portion and within a distance of 50 mm from the connecting edge of the sole portion; a product of an elastic modulus of the first outer shell member in a direction in which a striking surface is oriented and a thickness of the first outer shell member in the first region is taken as a first equivalent rigidity; and a product of an elastic modulus of the second outer shell member in the direction in which the striking surface is oriented and the thickness of the second outer shell member in the second region is taken as a second equivalent rigidity, the method comprising the steps of: holding in advance the characteristic data that expresses changes in initial ballistic characteristics of a golf ball caused when either of the first and second equivalent rigidities is changed while the other is kept constant; using the held characteristic data to set a ratio between the first equivalent rigidity and the second equivalent rigidity in accordance with the initial ballistic characteristics of the golf ball struck by a golfer; and employing two members which conform to the set ratio as the first and second outer shell members.

The ratio between the first equivalent rigidity and the second equivalent rigidity is to be considered as the ratio of one equivalent rigidity to the other, that is to say, the ratio may be of the first equivalent rigidity to the second or vice versa.

The characteristic data is prepared for each of plural head speeds at which golfers strike golf balls and the above ratio can be set according to a head speed. Alternatively, the characteristic data is prepared for each of loft angles and the above ratio can be set according to a loft angle.

In connection with the method of the present invention, it is preferable that a composite material in which a fiber reinforced plastic material is laminated is used for either or both of the first and second outer shell members and the above ratio is established by regulating an orientation angle of the composite material.

The present invention further provides a golf club comprising a hollow golf club head which has a face portion for striking a golf ball, a crown portion connected to the face portion, and a sole portion connected to the face portion, the golf club being included among a series of golf clubs adapted for different head speeds, wherein: a first region whose surface area constitutes 5% or more of the total surface area of the crown portion is formed by a first outer shell member in a region of the crown portion which is located along a connecting edge of the crown portion connecting to the face portion and within a distance of 50 mm from the connecting edge, and a second region whose surface area constitutes 5% or more of the total surface area of the sole portion is formed by a second outer shell member in a region of the sole portion which is located along a connecting edge of the sole portion connecting to the face portion and within a distance of 50 mm from the connecting edge of the sole portion; when a product of an elastic modulus of the first outer shell member in a direction in which a striking surface is oriented and a thickness of the first outer shell member in the first region is taken as a first equivalent rigidity and a product of an elastic modulus of the second outer shell member in the direction in which the striking surface is oriented and a thickness of the second outer shell member in the second region is taken as a second equivalent rigidity, a ratio of either lower of a first equivalent rigidity and a second equivalent rigidity to the higher is equal to or less than 0.75; and a composite material in which a fiber reinforced plastic is laminated is used for either or both of the first and second outer shell members, having an orientation angle of fibers thereof regulated according to the head speed so as to establish the above ratio.

Finally, the present invention provides a golf club comprising a hollow golf club head which has a face portion for striking a golf ball, a crown portion connected to the face portion, and a sole portion connected to the face portion, the golf club being included among a series of golf clubs with different loft angles, wherein: a first region whose surface area constitutes 5% or more of the total surface area of the crown portion is formed by a first outer shell member in a region of the crown portion which is located along a connecting edge of the crown portion connecting to the face portion and within a distance of 50 mm from the connecting edge, and a second region whose surface area constitutes 5% or more of the total surface area of the sole portion is formed by a second outer shell member in a region of the sole portion which is located along a connecting edge of the sole portion connecting to the face portion and within a distance of 50 mm from the connecting edge of the sole portion; when a product of an elastic modulus of the first outer shell member in a direction in which a striking surface is oriented and a thickness of the first outer shell member in the first region is taken as a first equivalent rigidity and a product of an elastic modulus of the second outer shell member in the direction in which the striking surface is oriented and a thickness of the second outer shell member in the second region is taken as a second equivalent rigidity, a ratio of either lower of a first equivalent rigidity and a second equivalent rigidity to the higher is equal to or less than 0.75; and a composite material in which a fiber reinforced plastic is laminated is used for either or both of the first and second outer shell members, having an orientation angle of fibers thereof regulated according to a loft angle of the golf club so as to establish the above ratio.

BEST MODE OF IMPLEMENTING THE INVENTION

The golf club of the present invention, and the method of designing a hollow golf club head of the present invention, are described in detail below based on preferred embodiments shown in the accompanying drawings.

Figure 1:
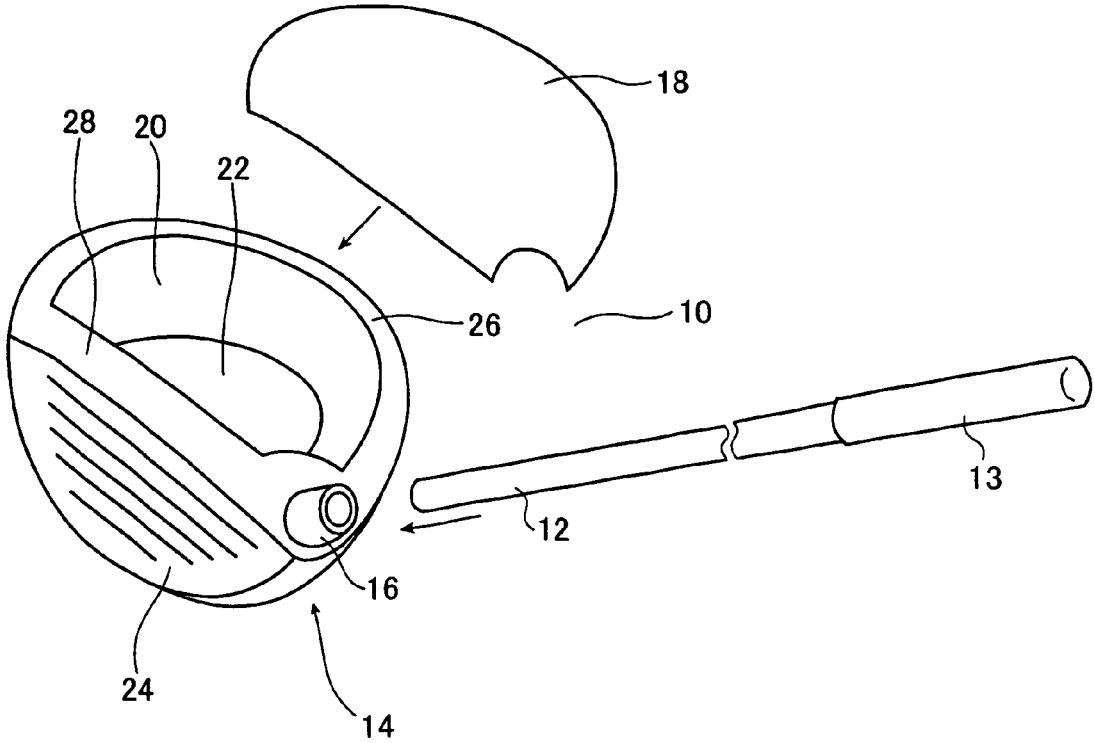
FIG. 1 is an exploded perspective view schematically showing a golf club as an embodiment of the golf club of the present invention.

FIG. 1 is an exploded perspective view schematically showing a golf club as an embodiment of the golf club of the present invention.

A golf club 10 shown in FIG. 1 is structured so that it has a golf club shaft 12 provided with a grip portion 13 at one end, and a hollow golf club head (hereinafter referred to simply as golf club head) 14 connected to the other end of the golf club shaft 12.

The golf club shaft 12 is inserted into a neck member 16 and bonded in place, thus being integrated with the golf club head 14.

The golf club head 14 has a face portion that strikes a golf ball, a crown portion that is connected to the face portion, and a sole portion that is connected to the face portion, and is provided with a crown member 18 that forms the major part of the crown portion, a side member 20 that mainly forms the side portion, a sole member 22 that forms the sole portion, and a face member 24 that forms the face portion and has a golf ball-striking surface, each as an outer shell member.

The side member 20, the sole member 22, and the face member 24 are integrated with one another in advance by welding, by using an adhesive, or the like. The side member 20 has an edge which is bent to the crown portion side to provide an extension portion 26 extending in the crown portion to form a part thereof. The face portion 24 has an edge which is bent to the crown portion side to provide an extension portion 28 extending in the crown portion to form a part thereof. That is, the side member 20, the sole member 22, and the face member 24 are previously integrated with one another into the state as shown in FIG. 1, and then the crown member 18 is joined to the extension portions 26 and 28, the golf club head 14 being thus constructed.

One out of various types of alloy materials is used for the side member 20, the face member 24, and the sole member 22, such as a titanium alloy, an aluminum alloy, or a stainless steel alloy. For the sole member 22, a composite material structured by laminating a fiber reinforced plastic material in a plurality of layers as will be described later and other materials may also be used.

The crown member 18 is structured by a composite material in which a plurality of layers of a carbon fiber reinforced plastic material having different orientation angles are laminated together. An epoxy resin, an unsaturated polyester resin, a vinyl ester resin, or the like may be used as a matrix. It should be noted that reinforcing fibers other than carbon fibers, such as glass fibers and aramid fibers, may also be used in the present invention.

The crown member 18 forms a region whose surface area constitutes 5% or more of the total surface area of the crown portion (hereafter referred to as the first region) in an area of the crown portion which is located along the connecting edge of the crown portion connecting to the face portion and within a distance of 50 mm from the connecting edge. The first region formed by the crown member 18 will be described in detail later.

When an equivalent crown rigidity is defined as the product of the elastic modulus (Young's modulus) of the crown member 18 in the direction in which the striking surface is oriented and the thickness of the crown member 18 and an equivalent sole rigidity is defined as the product of the elastic modulus of the sole member 22 in the direction in which the striking surface is oriented and the thickness of the sole member 22, the ratio of the equivalent crown rigidity to the equivalent sole rigidity is equal to or less than 0.5 in the embodiment as shown. The elastic modulus in the direction in which the striking surface is oriented is the elastic modulus whose values are obtained in the direction in which the line of intersection of the crown portion and a plane which is perpendicular to the striking surface of the face portion lies.

The direction in which the striking surface is oriented as referred to above should be considered as the azimuthal direction which is the oriented direction of the striking surface in a plane parallel to a reference plane when the golf club head addressed in an ordinary position on the reference plane is looked down on perpendicularly to the reference plane. The expression "addressed in an ordinary position" used herein means that the golf club head is addressed in accordance with the lie angle, with the central axis of the golf club shaft and the leading edge of the face portion of the golf club head being found to be parallel to each other. The expression "addressed in accordance with the lie angle" used herein means to be addressed such that the gap between the round surface of the sole portion as the bottom surface of the golf club head and the reference plane does not essentially vary from the toe side to the heel side. If the round surface of the sole portion is indefinite, the golf club may be addressed such that the score-lines made on the striking surface are parallel to the reference plane. If the round surface of the sole portion is indefinite and, in addition, the score lines are hard to determine whether or not to be parallel to the reference plane because of their being not straight lines, and so forth, the lie angle is set using the equation: the lie angle (degrees)=(100−the club length (inches)). In the case of the club length of 44 inches, for instance, the lie angle is 100−44=56 degrees.

The club length is measured by the mensuration established by Japan Golf Goods Association. Examples of the measuring instrument to be used include Club Measure II manufactured by Kamoshita Seikoujyo Corporation.

The elastic modulus as above is defined as follows on condition that the golf club head is addressed in an ordinary position in the horizontal reference plane.

Supposing that there is the plane extending in the direction in which the striking surface of the face portion is oriented when the golf club head is addressed in an ordinary position in the horizontal reference plane, that is perpendicular to both the reference plane and the striking surface, the above elastic modulus is the elastic modulus whose values are obtained in the direction in which the line of intersection of the plane as supposed above and the crown portion lies.

In this embodiment, the backspin rate of the golf ball struck with the striking surface is reduced and the launch angle of the ball is increased by setting the ratio as described above to 0.5. According to the present invention, however, the ratio of the equivalent crown rigidity to the equivalent sole rigidity can be set to 0.75 or less.

Figure 2A:
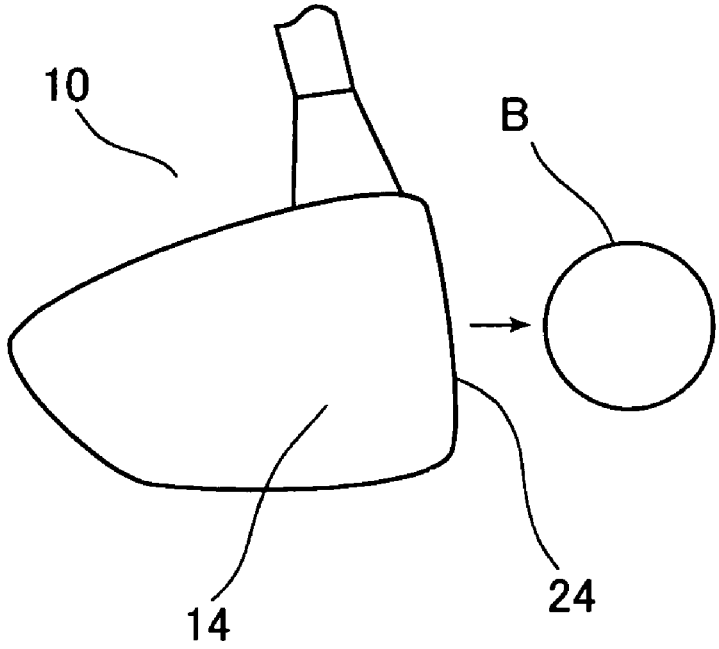
FIGS. 2A and 2B are diagrams clearly explaining the deformation caused when a golf ball is struck with the golf club.
Figure 2B:
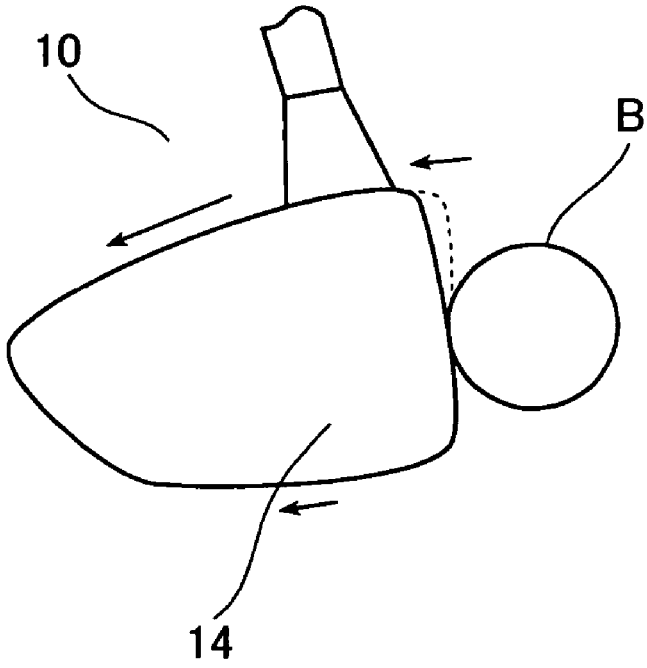

FIGS. 2A and 2B are explanatory diagrams for explaining, in an easy to understand manner, how a golf ball is struck with the golf club 10.

As shown in FIG. 2A, when a golf ball is struck, an impact force of the golf ball acts on the striking surface of the face member 24, and the impact force is transmitted to the crown portion and the sole portion. Now, directing attention to deformations of the crown portion and the sole portion that are generated due to the impact force, the equivalent crown rigidity is half as high as the equivalent sole rigidity, and the deformation of the crown portion therefore becomes larger than the deformation of the sole portion. The striking surface of the face member 24 therefore deforms slightly in such a direction as realizing a larger loft angle as shown in FIG. 2B. This deformation of the striking surface when impacted by the golf ball B affects the backspin rate and the launch angle of the golf ball B.

Figure 3A:
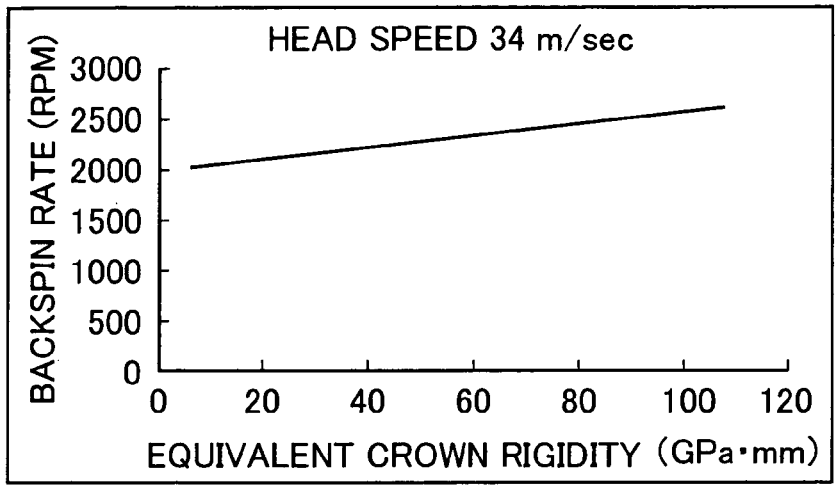
FIGS. 3A to 3C are diagrams that show changes in the backspin rate of a golf ball with respect to changes in equivalent crown rigidity.
Figure 3B:
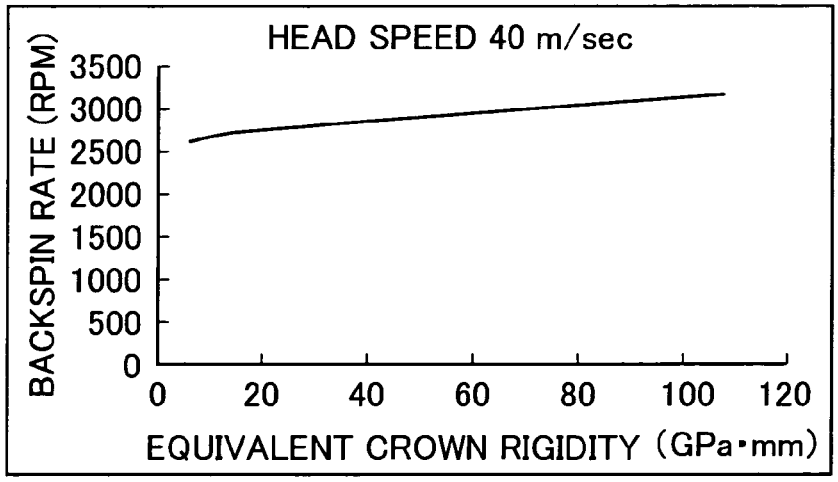
Figure 3C:
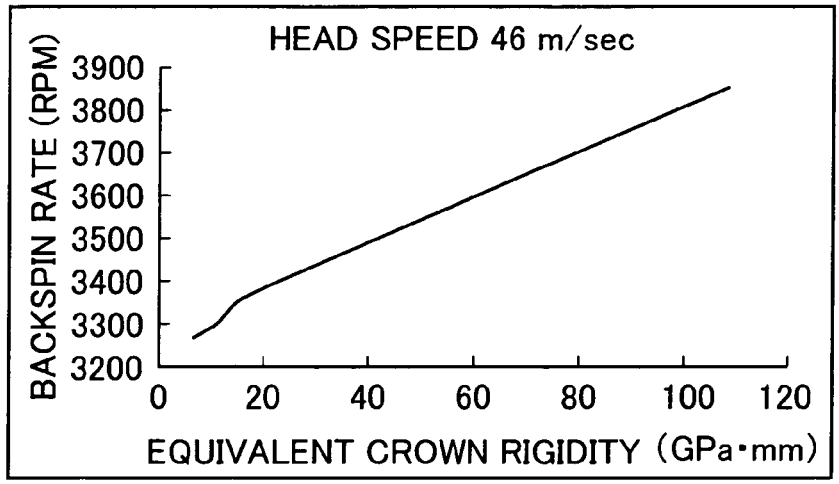

FIGS. 3A to 3C show changes in the backspin rate for cases where the equivalent crown rigidity is changed while keeping the equivalent sole rigidity (113 GPa·mm) fixed, for head speeds of 34 m/s, 40 m/s, and 46 m/s. As shown in FIGS. 3A to 3C, although the amount of change differs according to the head speed, it can be understood that the backspin rate decreases due to the reduction in the equivalent crown rigidity in each of the cases.

Figure 4A:
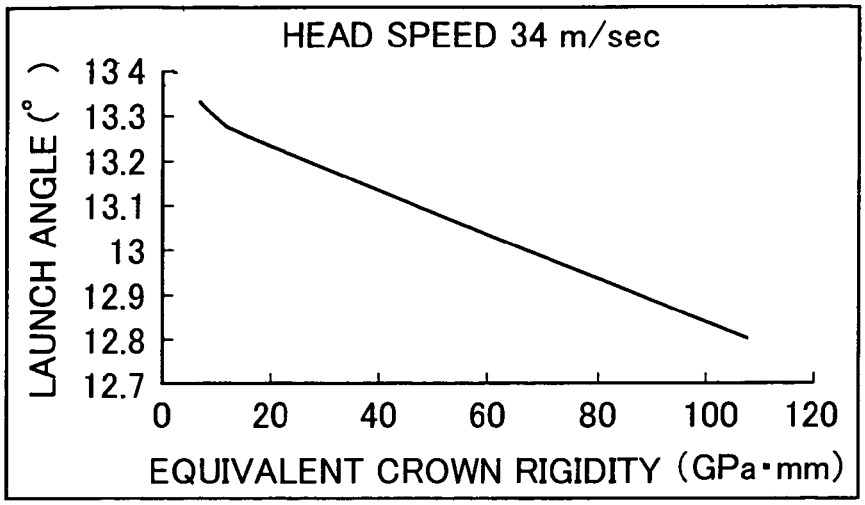
FIGS. 4A to 4C are diagrams that show changes in the launch angle of a golf ball with respect to changes in equivalent crown rigidity.
Figure 4B:
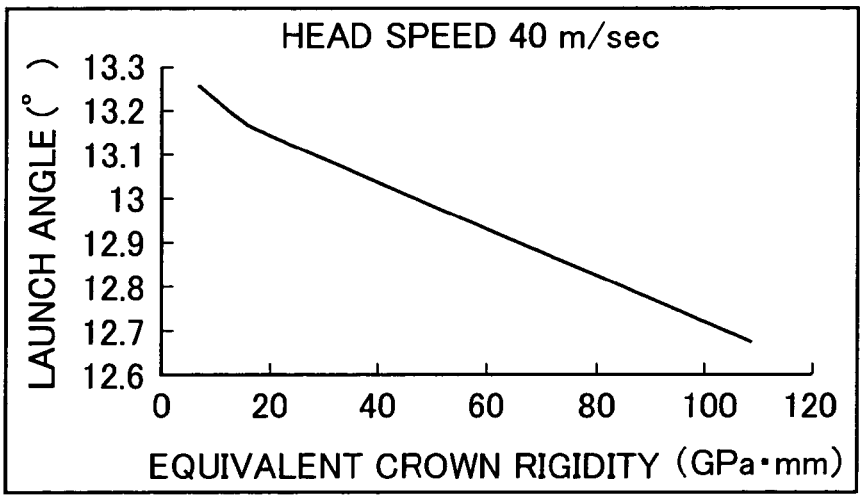
Figure 4C:
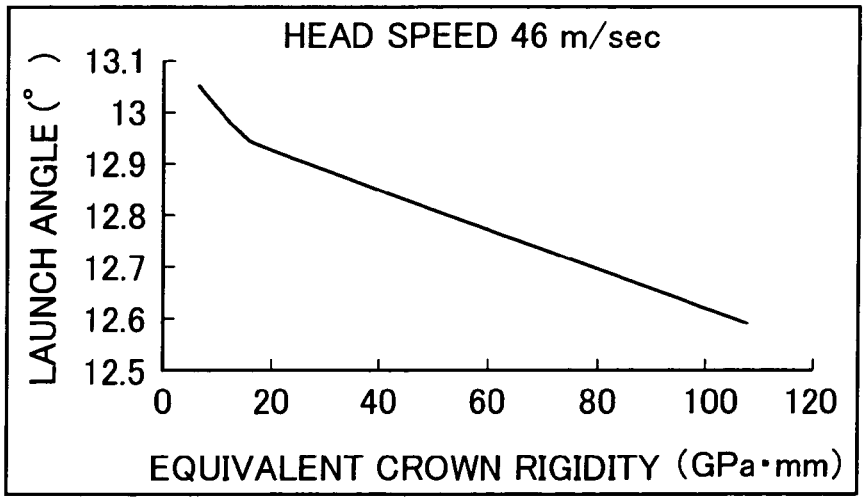

On the other hand, FIGS. 4A to 4C show changes in the launch angle for cases where the equivalent crown rigidity is changed while keeping the equivalent sole rigidity fixed (113 GPa·mm), for head speeds of 34 m/s, 40 m/s, and 46 m/s. As shown in FIGS. 4A to 4C, although the amount of change differs according to the head speed, it can be understood that the launch angle increases due to the reduction in the equivalent crown rigidity in each of the cases.

Figure 5A:
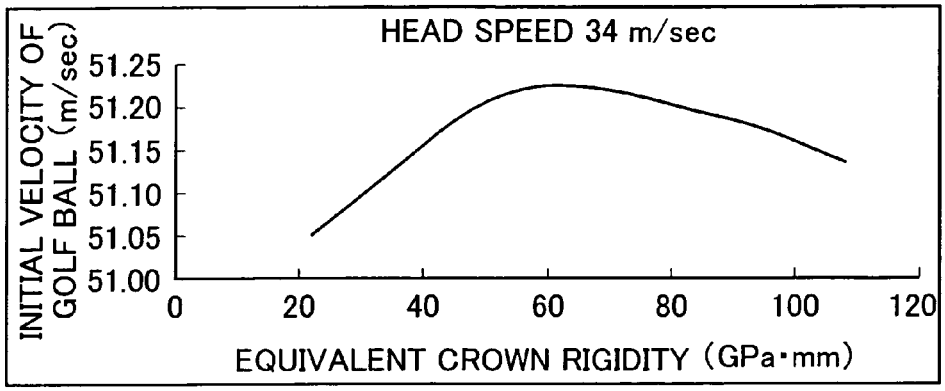
FIGS. 5A to 5C are diagrams that show changes in the initial velocity of a golf ball with respect to changes in equivalent crown rigidity.
Figure 5B:
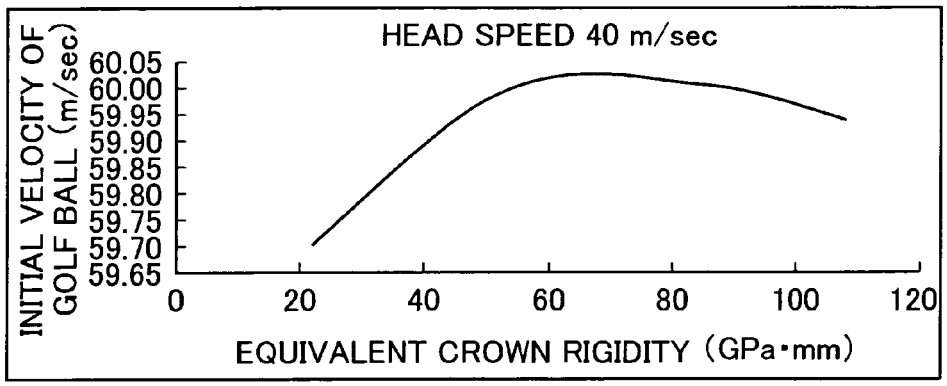
Figure 5C:
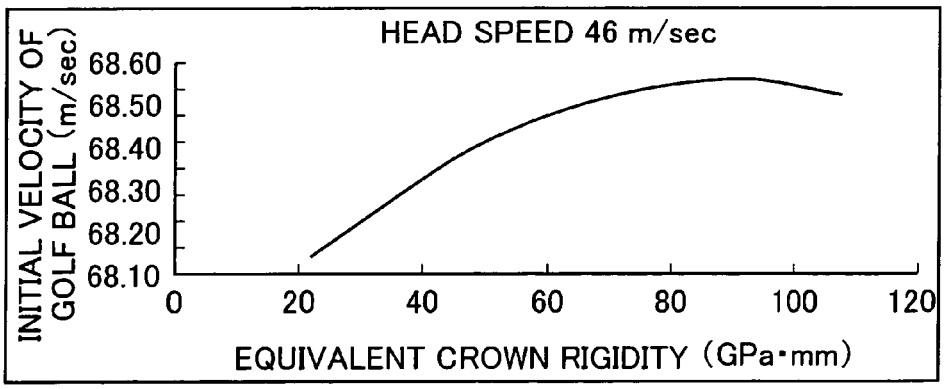

Further, FIGS. 5A to 5C show changes in the initial velocity of a golf ball for cases where the equivalent crown rigidity is changed while keeping the equivalent sole rigidity fixed (113 GPa·mm), for head speeds of 34 m/s, 40 m/s, and 46 m/s. As shown in FIGS. 5A to 5C, it can be understood that, in each of the cases, there exists a value of the equivalent crown rigidity at which the initial velocity of a golf ball becomes the maximum.

In order to realize the member whose equivalent crown rigidity is as above, it is suitable to employ a composite material comprising a fiber reinforced plastic material. The composite material may be so fabricated as to have 7 or 3 layers and have an equivalent rigidity of a value from 0.37 to 5.63 times as large as the reference value as set forth in Table 1 below, for instance. In this respect, the reference value is defined as the value of the equivalent rigidity of a five layer composite material obtained by laminating 4 layers of carbon fiber reinforced plastic material, with the orientation angle of them being set alternately to +45 degrees and −45 degrees with respect to the predetermined reference direction, and piling the uppermost layer of carbon fiber reinforced plastic material having an orientation angle of 90 degrees onto the laminate formed. The reference direction is defined as the direction in which the line of intersection of the crown portion and the plane perpendicular to the striking surface of the face portion lies.

Figure 6:
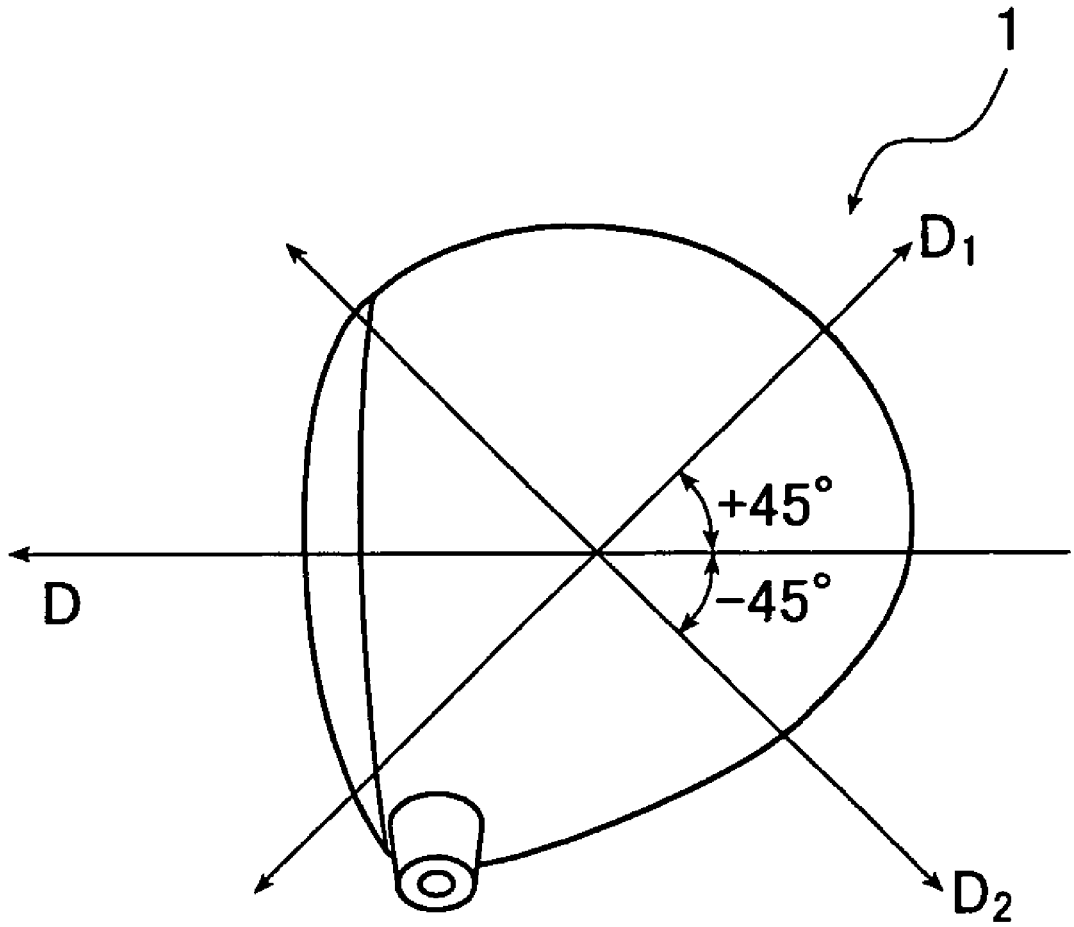
FIG. 6 is a diagram explaining the orientation angle in the golf club head of the present invention.

FIG. 6 illustrates the orientation angle of reinforcing fibers in the crown member with respect to the direction D in which the striking surface is oriented. The fibers having an orientation angle of +45 degrees are oriented in the direction as shown by $D_1$ and those having an orientation angle of −45 degrees in the direction as shown by $D_2$.

In this invention, the crown member may also be composed of a material in the form of a fabric-like cross prepreg, in which reinforcing fibers incorporated in fiber reinforced plastic layers are oriented in different directions, that is to say, at different orientation angles of, for instance, −45 degrees and +45 degrees. In that case, a layer of such material formed should be considered to possess a two-layer structure.

Referring now to Table 1, the member composed of 3 laminated layers each having an orientation angle of 0° or 90°, for instance, is formed such that the layers have orientation angles of 90°, 0°, and 90°, from the lowermost to the uppermost layers sequentially. The member composed of 7 laminated layers each having an orientation angle of +60°, −60° or 90° is formed such that the layers have orientation angles of +60°, −60°, +60°, −60°, +60°, −60°, and 90°, from the lowermost to the uppermost layers sequentially.

Graphs shown in FIGS. 3A to 3C, 4A to 4C, and 5A to 5C can be obtained by manufacturing the golf club head 10 by using such a composite material as set forth in the table in the crown member 18, and performing golf ball striking tests to measure the initial ballistic characteristics of a golf ball.

TABLE 1

| | | Equivalent crown rigidity value | | | |
|---|---|---|---|---|---|
| Number of laminated layers | Thickness | Orientation angle 0°, 90° | Orientation angle ±30°, 90° | Orientation angle ±45°, 90° | Orientation angle ±60°, 90° |
| 3 | 0.51 mm | 2.30 | 1.26 | 0.56 | 0.37 |
| 5 | 0.85 mm | 3.96 | 2.39 | 1.00 | 0.62 |
| 7 | 1.18 mm | 5.63 | 3.52 | 1.44 | 0.87 |

In Table 2 below, values of the equivalent rigidity of various alloy materials are represented as the ratio to the reference value as described before. The equivalent rigidity of the alloy materials is generally high as compared with that of the laminated composite materials comprising a carbon fiber reinforced plastic material as described above.

TABLE 2

| Material | Thickness | Equivalent crown rigidity value |
|---|---|---|
| Ti-6-4 alloy | 1 mm | 8.81 |
| SUS | 1 mm | 15.07 |
| Al alloy | 1 mm | 5.32 |
| Mg alloy | 1 mm | 3.37 |

In the table, Ti-6-4 alloy is the titanium alloy constituted of 6% by weight of Al, 4% by weight of V, and Ti as the remainder. SUS is the precipitation-hardened stainless steel (stainless steel alloy) constituted of 0.06% by weight of C, 0.4% by weight of Si, 0.6% by weight of Mn, 7.0% by weight of Ni, 17.0% by weight of Cr, 1.2% by weight of Al, and Fe as the remainder.

Al alloy (aluminum alloy) is the alloy constituted of 5.6% by weight of Zn, 2.5% by weight of Mg, 1.6% by weight of Cu, and Al as the remainder. Mg alloy (magnesium alloy) is the alloy constituted of 3.5% by weight of Zn, 0.6% by weight of Zr, and Mg as the remainder.

From these results, it is preferable in order to cause the deformation of the striking surface as shown in FIG. 2B to use an alloy material for the sole member 22 and a composite material, in which a carbon reinforced fiber plastic material is laminated, for the crown member 18.

The deformation of the striking surface of the face member 24 shown in FIG. 2B can be effectively achieved with such structure by satisfying certain conditions. Specifically, the crown member 18 should include the first region which exists in the region of the crown portion located along the connecting edge of the crown portion connecting to the face portion and within 50 mm of the connecting edge and whose surface area constitutes 5% or more of the total surface area of the crown portion. Similarly, the sole member 22 should include a second region (hereafter referred to as the second region) which exists in the region of the sole portion located along the connecting edge of the sole portion connecting to the face portion and within 50 mm of the connecting edge of the sole portion and whose surface area constitutes 5% or more of the total surface area of the sole portion.

Figure 7A:
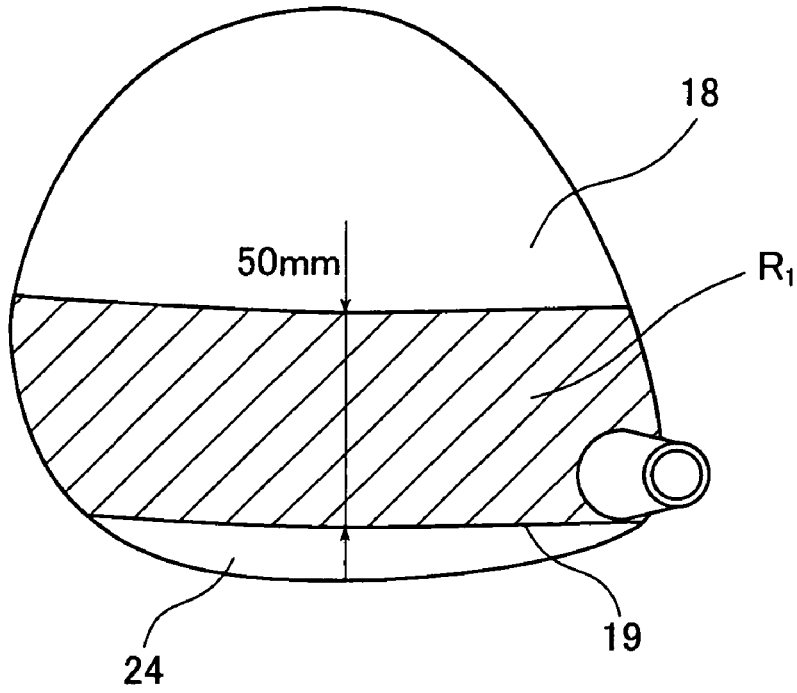
FIGS. 7A and 7B are diagrams explaining the crown portion of the golf club head of the present invention.

The first region in the crown member 18 is described in detail with reference to an example of the golf club head as shown in FIG. 7A. In this connection, similar definitions are to be given to the second region in the sole member 22.

The crown member of the golf club head as shown in FIG. 7A is a single member composed of a composite material.

In the case of the golf club head as shown in FIG. 7A, the region of the crown portion located along the connecting edge of the crown portion connecting to the face portion and within 50 mm of the connecting edge is a region $R_1$ as shown with hatching, which is located along a connecting edge 19 and within a distance of 50 mm from the connecting edge 19, and the member that is employed in the region $R_1$ for a region whose surface area constitutes 5% or more of the total surface area of the crown portion (the first region) is considered as the first region in the crown member 18 in the present invention.

In the embodiment as described above, the crown member is a single member composed of an alloy material, a composite material, or the like. The present invention, however, is not limited to the embodiment and the crown member may comprise two or more members of different types.

Figure 7B:
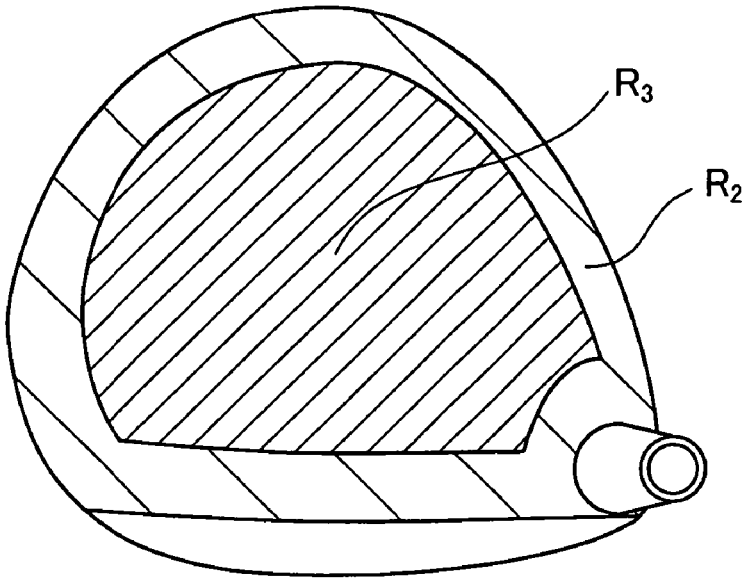

Referring to another example of the golf club head as shown in FIG. 7B, the first region in the crown member comprising two members of different types is described. In the golf club head as shown in FIG. 7B, the crown member 18 comprises two members composed of two different materials, such as an alloy material and a composite material, respectively.

In a region $R_2$, two different members are arranged in a layered manner (for instance, as the lower layer of a titanium alloy and the upper layer of a fiber reinforced plastic material laminated in itself in 5 layers), while a single member (for instance, a layer of a fiber reinforced plastic material laminated in itself in 5 layers) is used in a region $R_3$. In this situation, the member that is employed for a part of the region $R_2$ overlapping the region of the crown portion located along the connecting edge 19 of the crown portion connecting to the face portion and within 50 mm of the connecting edge (see the region $R_1$ in FIG. 7A) is considered as the first region in the crown member 18 in the present invention as long as the surface area of the part constitutes 5% or more of the total surface area of the crown portion. The member that is employed for a part of the region $R_3$ overlapping the region $R_1$ is also considered as the first region in the crown member 18 in the present invention as long as the surface area of the part constitutes 5% or more of the total surface area of the crown portion.

Thus, in the case of such a golf club head as shown in FIG. 7B, a plurality of first regions may be defined in the crown member 18. It should be noted that a ratio of the equivalent crown rigidity to the equivalent sole rigidity equal to or less than 0.75 has only to be attained with one of a plurality of first regions. Similar to the first region, a plurality of second regions may be defined in the sole member 22.

As described above, the deformation of the striking surface of the face member 24 as shown in FIG. 2B is effectively achieved in the golf club head of the golf club according to the present invention. It is a feature of the present invention that the first and second regions with which the ratio of the equivalent crown rigidity to the equivalent sole rigidity stands at 0.75 or less, preferably at 0.5 or less, lies in the crown portion and the sole portion, respectively, with the first region in the crown portion, as having a surface area constituting 5% or more of the total surface area of the crown portion, being in a region of the crown portion located within 50 mm of the connecting edge of the crown portion connecting to the face portion, and the second region in the sole portion, as having a surface area constituting 5% or more of the total surface area of the sole portion, being in a region of the sole portion located within 50 mm of the connecting edge of the sole portion connecting to the face portion. There are no particular limitations placed on the positions of the first and second regions, provided that the regions each lies in a region located along the connecting edge of the relevant portion connecting to the face portion and within 50 mm of the connecting edge. It is preferable, however, that the first and second regions each lie in a region located within 40 mm of the connecting edge to the face portion. Further, it is preferable that the first and second regions each has a surface area constituting 10% or more of the total surface area of the relevant portion. In this respect, the first and second regions may each be formed by an outer shell member composed of a single alloy material or that composed of a laminated composite material. There are of course no limitations placed on the thickness of the outer shell members in the first and second regions, provided that the members allow the ratio as referred to above to be 0.75 or less, preferably 0.5 or less.

The total surface area of the crown portion is the total surface area of a zone enclosed by the edges of the crown portion connecting to the side portion, the face portion and the neck member 16, respectively, and such connecting edges can be found out based on the change in radius of curvature on the periphery of the crown portion. Similarly, the total surface area of the sole portion is the total surface area of a zone enclosed by the edges of the sole portion connecting to the side portion and the face portion, respectively. If the crown portion is indefinite due to the painting on the outer surface of a golf club head, the golf club head may be decomposed so as to inspect joining parts from inside and thereby find out the edges of the side portion, the crown portion, and the sole portion. In the case of the crown portion still being indefinite, it is also possible to consider the projected area of the golf club head except for the striking surface, that is found by looking down on a golf club head perpendicularly to the plane on which the golf club head is placed such that the striking surface is oriented properly in line with its loft angle, as the total surface area of the crown portion.

If the crown member 18 or the sole member 22 has certain thickness distribution, the average thickness of the member is considered as its thickness. In the golf club head of the golf club according to the present invention, as described before, the first and second regions which allow the ratio of the equivalent crown rigidity to the equivalent sole rigidity to be 0.75 or less, preferably 0.5 or less, lie in the regions of the crown portion and the sole portion, each located within 50 mm of the connecting edge of the relevant portion connecting to the face portion, and they each have a surface area constituting 5% or more of the total surface area of the relevant portion. It is also the case with the outer shell members in the first and second regions as such, so that the average thickness of the outer shell member having a thickness distribution, if any, is considered as its thickness.

With the golf club 10, the backspin rate of the struck golf ball can be reduced and its launch angle can be increased by the deformation of the striking surface when impacted as shown in FIG. 2B because of the ratio of the equivalent crown rigidity to the equivalent sole rigidity of the golf club head 14 being equal to or less than 0.5, as described above.

It should be noted that, although a structure is used in the embodiment described above where the ratio of the equivalent crown rigidity to the equivalent sole rigidity is equal to or less than 0.5, it is also possible according to the present invention to use a structure in which the ratio of the equivalent sole rigidity to the equivalent crown rigidity is equal to or less than 0.75, preferably equal to or less than 0.5. In other words, the ratio of the equivalent crown rigidity to the equivalent sole rigidity may also be set to 4/3 or more, preferably to 2 or more.

In that case, the initial ballistic characteristics of a golf ball may be adjusted on the golf club head side such that the backspin rate be increased and the launch angle reduced. Specifically, a composite material in which a carbon fiber reinforced plastic material is laminated in layers may be used for the sole member 22 and any of various alloy materials including titanium alloys, aluminum alloys, and stainless steel alloys may be used for the crown member 18. The sole member 22 composed of a composite material will be joined integrally with the bonding surfaces provided on the side member 20 and the face member 24 using an adhesive and so forth. This type of golf club head readily allows a golf ball to follow a trajectory at a lower level so that it is most suitable for golfing on a windy day.

Further, a composite material in which a plurality of layers of a fiber reinforced plastic material are laminated may be used for both the crown member 18 and the sole member 22 at a time. In this respect, there is nothing required but that the ratio of either lower of the equivalent crown rigidity and the equivalent sole rigidity to the higher be equal to or less than 0.75.

Thus according to the present invention, the backspin rate and the launch angle can be adjusted separately from each other, whereas these two characteristics should be increased or decreased alike when a conventional change in the loft angle of a golf club head is performed.

Figure 8:
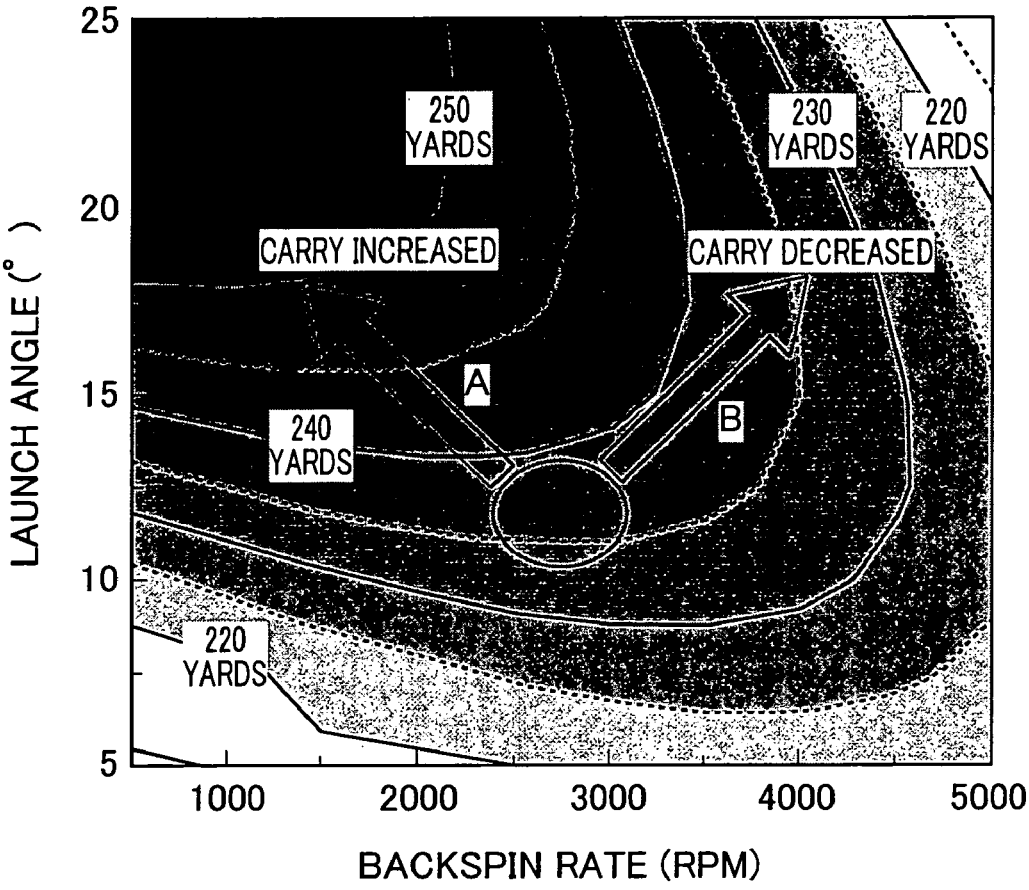
FIG. 8 is a diagram representing changes in the carry of a golf ball according to the backspin rate and the launch angle, which are initial ballistic characteristics of a golf ball.

A method for designing the golf club as above is described with reference to FIG. 8. FIG. 8 is a chart representing changes in the carry of a golf ball according to the backspin rate and the launch angle, each as an initial ballistic characteristic of a golf ball. The chart shows the relationship between the backspin rate and the launch angle with contours, based on their values bringing about the same carry of a golf ball at a fixed head speed (head speed of 40 m/sec). As an example, when a golfer strikes a golf ball at a head speed of 40 m/sec, with the initial ballistic characteristics of the golf ball being such that the backspin rate is equal to 2,800 and the launch angle is equal to 12 degrees, the carry of the golf ball is nearly 236 yards.

In this case, in order to effectively increase the carry, the golfer must shift the backspin rate and the launch angle not in direction B but direction A shown in FIG. 8, i.e., a direction in which the launch angle increases and the backspin rate decreases. Such shift in direction A cannot be achieved by conventional adjustments of the loft angle because the launch angle and the backspin rate are increased or decreased alike. However, the shift in direction A can be achieved by using a structure in which the ratio of the equivalent crown rigidity to the equivalent sole rigidity is equal to or less than 0.75, preferably equal to or less than 0.5, as described above.

By knowing the initial ballistic characteristics of the golf ball struck by a golfer (the initial velocity, backspin rate, and launch angle), a direction for the increase in the carry of the golf ball can be found out in the chart shown in FIG. 8. It is then preferable to set the backspin rate and the launch angle so that they may be shifted in the direction thus found out and determine the type of the materials for the crown member 18 and the sole member 22 (type of alloy and type of fiber reinforced plastic material) and the member structure (orientation angle in a laminated material, for instance) so that they may conform to the direction, that is to say, may allow the ratio of the equivalent crown rigidity to the equivalent sole rigidity to be equal to or less than 0.75.

To be more specific, the golf club head can be designed as follows: Such characteristic data as shown in FIGS. 3A to 3C, FIGS. 4A to 4C, or FIGS. 5A to 5C is held in advance, which expresses the initial ballistic characteristics of a golf ball by using either or both of the equivalent crown rigidity in the first region formed by the crown member 18 and the equivalent sole rigidity in the second region formed by the sole member 22 as a parameter, with the first region being in a region of the crown portion which is located along the connecting edge of the crown portion connecting to the face portion and within a distance of 50 mm from the connecting edge and whose surface area constitutes 5% or more of the total surface area of the crown portion, and the second region being in a region of the sole portion which is located along the connecting edge of the sole portion connecting to the face portion and within a distance of 50 mm from the connecting edge of the sole portion and whose surface area constitutes 5% or more of the total surface area of the sole portion. A direction desirable for the increase in the carry, such as direction A in FIG. 8, is found out based on the initial ballistic characteristics of the golf ball struck by a golfer and the ratio between the equivalent crown rigidity and the equivalent sole rigidity is set using the held characteristic data so that the shift in the found-out direction may be effected. The members that conform to the set ratio are employed as the outer shell member whose surface area constitutes 5% or more of the total surface area of the crown portion and the outer shell member whose surface area constitutes 5% or more of the total surface area of the sole portion and arranged in the regions of the crown portion and the sole portion, each located along the connecting edge of the relevant portion connecting to the face portion and within 50 mm of the connecting edge, respectively.

In the embodiment as described above, the ratio of the equivalent crown rigidity to the equivalent sole rigidity is set to 0.5 or less so as to adjust the initial ballistic characteristics of a golf ball in the direction allowing the increase in the launch angle and the decrease in the backspin rate (direction A) as shown in FIG. 8.

The initial ballistic characteristics of a golf ball, however, may also be adjusted such that the backspin rate is increased while the launch angle is decreased. In that case, the ratio of the equivalent sole rigidity to the equivalent crown rigidity may be set to 0.75 or less, preferably 0.5 or less.

In other words, a golf club head with which the backspin rate and the launch angle are changed independently of each other can be designed by setting the ratio of either lower of the equivalent crown rigidity and the equivalent sole rigidity to the higher to 0.75 or less.

The above designing method can be followed by computer.

In this respect, the characteristic data differs according to the head speed, as shown in FIGS. 3A to 3C, FIGS. 4A to 4C, and FIGS. 5A to 5C. Therefore, in order to quantitatively determine the ratio between the equivalent crown rigidity and the equivalent sole rigidity to thereby ensure an increase in the carry, it is preferable to set the ratio between the equivalent crown rigidity and the equivalent sole rigidity according to the head speed.

Moreover, the golf club provided with such a hollow golf club head as described above can be brought to market as one in a series of golf clubs in which the orientation angle of a composite material such as a fiber reinforced plastic material for the crown member or the sole member is determined differently according to the head speed. The head speed at which individual golfers strike a golf ball may be typified in 43 m/sec, 40 m/sec, and 37 m/sec, for instance. Under such conditions, the orientation angle of a composite material in the golf club head is set to ±30° for a golf club adapted for a head speed of 43 m/sec, ±45° for a golf club adapted for a head speed of 40 m/sec, and ±60° for a golf club adapted for a head speed of 37 m/sec. It should be noted that the rigidity of a composite material in the golf club head is decreased as the orientation angle of the material is increased in magnitude from ±30° to ±45°, then to ±60°.

In this way, a series of golf clubs classified by different head speeds at which golfers respectively strike a golf ball can be brought to market. The term "a series of golf clubs" herein used means a group of golf clubs which are designed for a certain distinctive structure and performance under one and the same brand name, model name, trade name, type designation, variation designation, and so forth. In addition to a group of golf clubs having the distinctive structure and performance attained therein, a group of golf clubs which are indicated to be designed for the distinctive structure and performance in the instructions for golf clubs or through a catalogue, a poster or panel displayed at the store, a TV commercial message, a promotive video, which are published or produced by a golf club maker or a golf club sales company, various advertising medias exemplified by a telecommunication or the like, are also considered to have the distinctive structure or performance attained therein and included in the present invention as "a series of golf clubs".

By using the method of designing a hollow golf club head as above, a custom-made golf club head can be provided by setting the ratio between the equivalent crown rigidity and the equivalent sole rigidity in accordance with the initial ballistic characteristics of the golf ball struck by a specified golfer. Golf clubs that are designed by setting the ratio between the equivalent crown rigidity and the equivalent sole rigidity in accordance with such initial ballistic characteristics of a golf ball as presumed can also be brought to market.

Figure 9:
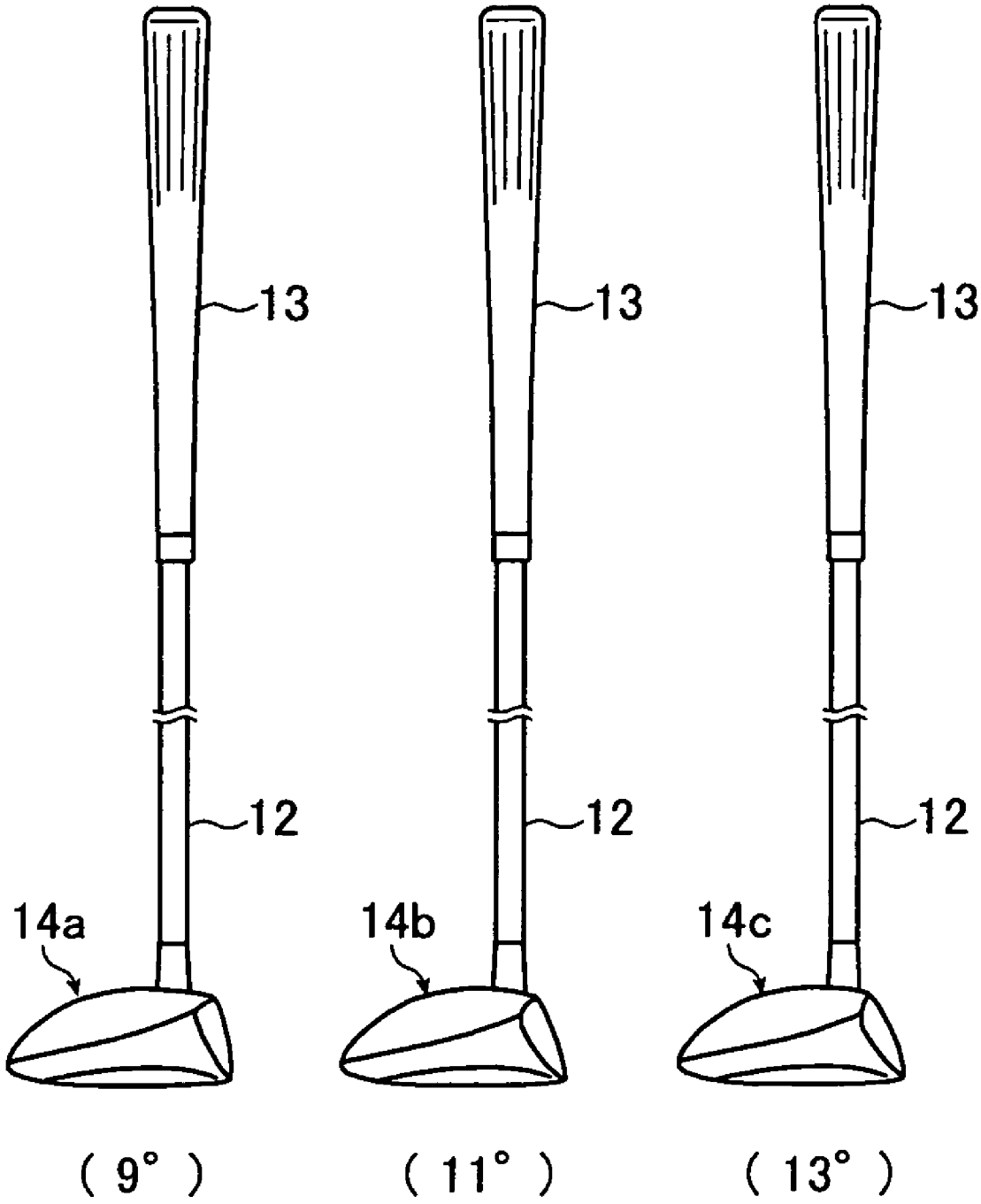
FIG. 9 is a schematic diagram showing an exemplary series of golf clubs with different loft angles.

FIG. 9 is a schematic illustration of an exemplary series of golf clubs with different loft angles of the present invention, showing three golf clubs different from one another in loft angle.

Each golf club has the golf club shaft 12 provided with the grip portion 13 at one end and the golf club head 14 as described above at the other. The golf club head 14 is attached to the golf club shaft 12 via a socket of a hosel projected upwardly from the head on the heel side. In the golf club heads 14*a* to 14*c* of the respective golf clubs, the equivalent rigidity ratio is established by differently determining the orientation angle of a composite material in which a fiber reinforced plastic is laminated.

The equivalent rigidity ratio as referred to above is the ratio of either lower of the equivalent crown rigidity and the equivalent sole rigidity to the higher and is obtained by adjusting either or both of the equivalent crown rigidity and the equivalent sole rigidity.

As seen from Table 1, the equivalent rigidity is increased as the orientation angle of a composite material is changed from ±60° and 90° to ±45° and 90°, then to ±30° and 90°, and then to 0° and 90°. Accordingly, a desired equivalent rigidity ratio can be established by regulating the orientation angle of a composite material.

A method of designing such golf clubs as shown is now described. By knowing the initial ballistic characteristics of the golf ball struck by a golfer (the initial velocity, backspin rate, and launch angle), desirable values of the backspin rate and the launch angle which increase the carry of the golf ball are found out in the chart of FIG. 8. The backspin rate and the launch angle are set to the values thus found out independently of each other and the type of the materials for the crown member and the sole member (type of fiber reinforced plastic material) and the member structure (orientation angle in a laminated material) are so determined as to conform to them.

The golf club head of each golf club is designed, for instance, as follows: Characteristic data which expresses the initial ballistic characteristics of a golf ball by using either or both of the equivalent crown rigidity and the equivalent sole rigidity as a parameter (for instance, data showing changes in the backspin rate or launch angle of a golf ball with respect to the changes in the equivalent crown rigidity or the equivalent sole rigidity) is held in advance according to the loft angle.

Desirable values of the backspin rate and the launch angle are found out in the chart of FIG. 8 based on the initial ballistic characteristics of the golf ball struck by a golfer and then, the ratio between the equivalent crown rigidity and the equivalent sole rigidity is set using the characteristic data held according to the loft angle so that the backspin rate and the launch angle are shifted toward the found-out desirable values. The members each having an orientation angle conforming to the set ratio are employed as the outer shell member whose surface area constitutes 5% or more of the total surface area of the crown portion and the outer shell member whose surface area constitutes 5% or more of the total surface area of the sole portion and arranged in the regions of the crown portion and the sole portion, each located along the connecting edge of the relevant portion connecting to the face portion and within 50 mm of the connecting edge, respectively.

This designing method can be followed by computer.

Since the characteristic data differs according to the loft angle, the ratio between the equivalent crown rigidity and the equivalent sole rigidity is set for each loft angle value selected for design so as to quantitatively determine the ratio between the equivalent crown rigidity and the equivalent sole rigidity to thereby ensure an increase in the carry.

The backspin rate and the launch angle can be adjusted more freely and in a more dynamic manner especially because of their adjustments being carried out by changing not only the equivalent rigidity ratio but also the loft angle.

It is seen from Table 1 that the equivalent crown rigidity is increased as the number of laminated layers becomes larger, which indicates that the equivalent rigidity of a member composed of a composite material can be adjusted by regulating the number of laminated layers. In consequence, the equivalent rigidity ratio can be established by regulating the number of laminated layers of a composite material apart from regulating the orientation angle thereof.

The golf club provided with such a hollow golf club head as above can be brought to market as one in a series of golf clubs in which the orientation angle of a composite material such as a fiber reinforced plastic material for the crown member or the sole member is determined differently according to the loft angle.

The brand name, model name, trade name, type designation, variation designation, or the like of the series of golf clubs may be presented through advertising media and then a golfer who is going to purchase a golf club can select the golf club provided with the golf club head with a particular loft angle by referring to the trade name or the type designation so as to obtain the initial ballistic characteristics of a golf ball as desired.

EXAMPLE A

The carry of a golf ball was measured using the golf club of the present invention to examine the effects with respect to the ratio of the equivalent crown rigidity to the equivalent sole rigidity.

Various golf clubs (Examples 1 to 5 and Comparative Examples 1 and 2) were fabricated by using the hollow golf club head shown in FIG. 1 as the hollow golf club head of the present invention. The ratio of the equivalent crown rigidity to the equivalent sole rigidity was differed from head to head by changing the equivalent crown rigidity as shown in Table 3 below.

For the crown member 18, the composite material which comprises a plurality of laminated layers of a carbon fiber reinforced plastic material containing an epoxy resin as the matrix and carbon fibers with an elastic modulus of $24\times10^3$ (kgf/mm$^2$) as reinforcing fibers, with the orientation angle of the carbon fibers being alternated layer by layer, was used. The 6-4 titanium alloy shown in Table 2 was used for the side member 20, the sole member 22, and the face member 24.

The carry measurement was conducted by performing the golf ball-striking test by five golfers as testers on the fabricated golf clubs five times repeatedly so as to get the average carry for each club. Average carries were represented by index numbers based on the average carry of Comparative Example 2 as the reference (index number of 100), with a larger one being represented by a larger number.

The index numbers of the average carries are set forth in Table 3 as the measurement results. It can be seen from the measurement results that the average carry increased greatly when the ratio of the equivalent crown rigidity to the equivalent sole rigidity was equal to or less than 0.75 (Example 5 as compared with Comparative Example 1), and that the average carry increased even further when the ratio was equal to or less than 0.5 (Example 3 as compared with Example 4).

EXAMPLE B

The carry of a golf ball was again measured using the golf club of the present invention to examine the effects with respect to the ratio (%) of the surface area of the first region of the crown portion to the total surface area of the crown portion, with the first region allowing the ratio of the equivalent crown rigidity to the equivalent sole rigidity of 0.5 or less (of 0.4). Specifically, such examination was conducted by variously changing the first region of the crown portion allowing the ratio of the equivalent crown rigidity to the equivalent sole rigidity of 0.4 in surface area, thus causing the above ratio of its surface area to vary. The first region was in a region of the crown portion located within 50 mm of the connecting edge of the portion connecting to the face portion.

The member used in the first region of the crown portion was composed of a carbon fiber reinforced plastic material containing an epoxy resin as the matrix and carbon fibers with an elastic modulus of $24\times10^3$ (kgf/mm$^2$) as reinforcing fibers and had an equivalent crown rigidity of 45.2 (GPa·mm). The 6-4 titanium alloy shown in Table 2 was used for the members in the sole portion, the face portion, and the side portion, as well as the crown portion other than the first region. The equivalent sole rigidity was 113 (GPa·mm).

As shown in Table 4 below, the ratio of the surface area of the first region to the total surface area of the crown portion was changed from 3 to 70% (Examples 6 to 10 and Comparative Examples 3 and 4), and changes in the carry were examined.

TABLE 3

| | Example 1 | Example 2 | Example 3 | Example 4 | Example 5 | Comparative Example 1 | Comparative Example 2 |
|---|---|---|---|---|---|---|---|
| Equivalent crown rigidity (GPa · mm) | 12.5 | 45.2 | 55.4 | 72.3 | 83.6 | 90.4 | 113 |
| Equivalent sole rigidity (GPa · mm) | 113 | 113 | 113 | 113 | 113 | 113 | 113 |
| Equivalent crown rigidity/ Equivalent sole rigidity | 0.11 | 0.40 | 0.49 | 0.64 | 0.74 | 0.80 | 1.00 |
| Average carry (index number) | 140 | 140 | 138 | 122 | 120 | 102 | 100 |

TABLE 4

| | Example 6 | Example 7 | Example 8 | Example 9 | Example 10 | Comparative Example 3 | Comparative Example 4 |
|---|---|---|---|---|---|---|---|
| Ratio of surface area (%) | 70 | 50 | 30 | 10 | 5 | 4 | 3 |
| Average carry (index number) | 140 | 130 | 125 | 120 | 112 | 101 | 100 |

The carry measurement was conducted by performing the golf ball-striking test by five golfers as testers on the fabricated golf clubs five times repeatedly so as to get the average carry for each club. Average carries were represented by index numbers based on the average carry of Comparative Example 2 as the reference (index number of 100), with a larger one being represented by a larger number.

The index numbers of the average carries are set forth in Table 4 as the measurement results. It can be seen from the measurement results that the increase in the average carry was small when the surface area ratio was equal to or less than 4% (Comparative Examples 3 and 4), while the average carry increased greatly when the surface area ratio was equal to or greater than 5%, with a value of 5% as the threshold. In particular, it can be seen that the average carry increased even further when the surface area ratio was equal to or greater than 10%.

Effects of the present invention become apparent from Examples A and B described above.

The golf club of the present invention and the method of designing a hollow golf club head of the present invention are described in detail above. However, the present invention is not limited to the embodiments described above. Various types of improvements and modifications may of course be made without departing from the gist of the present invention.

INDUSTRIAL APPLICABILITY

As described in detail above, the present invention can increase the carry of a golf ball based on a technique other than conventional ones such as adjustment of the loft angle and reduction in the thickness of the striking surface because, according to the present invention, the ratio of either lower of the equivalent crown rigidity and the equivalent sole rigidity to the higher is equal to or less than 0.75 so that it is possible to, for instance, decrease the backspin rate and increase the launch angle. The present invention also makes it possible to design a golf club head possessing such features as above. In addition, the present invention can provide a series of golf clubs adapted for different head speeds, or a series of golf clubs with different loft angles, in which the orientation angle is determined differently according to the loft angle.

What is claimed is:

1. A golf club comprising a hollow golf club head which has a face portion for striking a golf ball, a crown portion connected to the face portion, a sole portion connected to the face portion and a side portion connected to the face portion, the crown portion and the sole portion, wherein:

a first region whose surface area constitutes 5% or more of a total surface area of the crown portion is formed by a first outer shell member in a region of the crown portion which is located along a connecting edge of the crown portion connecting to the face portion and within a distance of 50 mm from the connecting edge, and a second region whose surface area constitutes 5% or more of the total surface area of the sole portion is formed by a second outer shell member in a region of the sole portion which is located along a connecting edge of the sole portion connecting to the face portion and within a distance of 50 mm from the connecting edge of the sole portion, the first outer shell member structured by a carbon fiber reinforced plastic material and the second outer shell member structured by a metal alloy; and when an product of an elastic modulus of the first outer shell member in a direction in which a striking surface is oriented and a thickness of the first outer shell member in the first region is taken as a first equivalent rigidity and a product of an elastic modulus of the second outer shell member in the direction in which the striking surface is oriented and a thickness of the second outer shell member in the second region is taken as a second equivalent rigidity, a ratio of either the lower of the first equivalent rigidity and the second equivalent rigidity to the higher is equal to or less than 0.75, wherein a side member of the side portion has an edge which is bent to a side of the crown portion to provide an extension portion extending in the crown portion to form a part thereof, wherein a face member of the face portion has an edge which is bent to a side of the crown portion to provide an extension portion extending in the crown portion to form a part thereof, and wherein the first outer shell member is joined to the extension portions from an outside of a hollow region formed by the face portion, the crown portion, the side portion and the sole portion.

2. The golf club according to claim 1, wherein: the face portion is structured by a metal alloy.

3. A method of designing a hollow golf club head which has a face portion for striking a golf ball, a crown portion connected to the face portion, a sole portion connected to the face portion and a side portion connected to the face portion, the crown portion and the sole portion, wherein:

a first region whose surface area constitutes 5% or more of the total surface area of the crown portion is formed by a first outer shell member in a region of the crown portion which is located along a connecting edge of the crown portion connecting to the face portion and within a distance of 50 mm from the connecting edge; a second region whose surface area constitutes 5% or more of the total surface area of the sole portion is formed by a second outer shell member in a region of the sole portion which is located along a connecting edge of the sole portion connecting to the face portion and within a distance of 50 mm from the connecting edge of the sole portion; a product of an elastic modulus of the first outer shell member in a direction in which a striking surface is oriented and a thickness of the first outer shell member in the first region is taken as a first equivalent rigidity; and a product of an elastic modulus of the second outer shell member in the direction in which the striking surface is oriented and a thickness of the second outer shell member in the second region is taken as a second equivalent rigidity, the method comprising the steps of:

holding in advance the characteristic data that expresses changes in initial ballistic characteristics of a golf ball caused when either of the first and second equivalent rigidities is changed while the other is kept constant;

using the held characteristic data to set a ratio between the first equivalent rigidity and the second equivalent rigidity in accordance with the initial ballistic characteristics of the golf ball struck by a golfer; and employing two members that conform to the set ratio as the first and second outer shell members, wherein a side member of the side portion has an edge which is bent to a side of the crown portion to provide an extension portion extending in the crown portion to form a part thereof; and wherein a face member of the face portion has an edge which is bent to a side of the crown portion to provide an extension portion extending in the crown portion to form a part thereof.

4. The method of designing a hollow golf club head according to claim 3, wherein:

said characteristic data represents each of plural head speeds at which golfers strike golf balls;

said characteristic data is prepared for each of plural head speeds at which golfers strike golf balls; and said ratio is set according to a head speed at which a golfer strikes golf balls.

5. The method of designing a hollow golf club head according to claim 4, wherein:

a composite material in which a fiber reinforced plastic material is laminated is used for said first outer shell member and a metal alloy for said second outer shell member; and said ratio is established by regulating an orientation angle of the composite material.

6. The method of designing a hollow golf club head according to claim 3, wherein:

said characteristic data represents each of plural loft angles of golf clubs;

said characteristic data is prepared for each of plural loft angles; and said ratio is set according to a loft angle of the golf clubs.

7. The method of designing a hollow golf club head according to claim 3, wherein:

the first outer shell member is joined to the extension portions from an outside of a hollow region formed by the face portion, the crown portion, the side portion and the sole portion.

8. A golf club comprising a hollow golf club head which has a face portion for striking a golf ball, a crown portion connected to the face portion, a sole portion connected to the face portion and a side portion connected to the face portion, the crown portion and the sole portion, wherein:

a first region whose surface area constitutes 5% or more of a total surface area of the crown portion is formed by a first outer shell member in a region of the crown portion which is located along a connecting edge of the crown portion connecting to the face portion and within a distance of 50 mm from the connecting edge, and a second region whose surface area constitutes 5% or more of the total surface area of the sole portion is formed by a second outer shell member in a region of the sole portion which is located along a connecting edge of the sole portion connecting to the face portion and within a distance of 50 mm from the connecting edge of the sole portion, the face portion being structured by a metal alloy; and when a product of an elastic modulus of the first outer shell member in a direction in which a striking surface is oriented and a thickness of the first outer shell member in the first region is taken as a first equivalent rigidity and a product of an elastic modulus of the second outer shell member in the direction in which the striking surface is oriented and a thickness of the second outer shell member in the second region is taken as a second equivalent rigidity, a ratio of either the lower of the first equivalent rigidity and the second equivalent rigidity to the higher is equal to or less than 0.75, wherein a side member of the side portion has an edge which is bent to a side of the crown portion to provide an extension portion extending in the crown portion to form a part thereof, wherein a face member of the face portion has an edge which is bent to a side of the crown portion to provide an extension portion extending in the crown portion to form a part thereof, and wherein the first outer shell member is joined to the extension portions from an outside of a hollow region formed by the face portion, the crown portion, the side portion and the sole portion.

9. The golf club according to claim 8, wherein:

the golf club is included among a series of golf clubs adapted for different head speeds; and a composite material in which a fiber reinforced plastic is laminated is used for either or both of the first and second outer shell members, having an orientation angle of fibers thereof regulated according to a head speed so as to establish said ratio.

10. The golf club according to claim 8, wherein:

the golf club is included among a series of golf clubs with different loft angles; and a composite material in which a fiber reinforced plastic is laminated is used for either or both of the first and second outer shell members, having an orientation angle of fibers thereof regulated according to a loft angle of the golf club so as to establish said ratio.

* * * * *